United States Patent [19]

Tilson et al.

[11] Patent Number: 4,532,780

[45] Date of Patent: Aug. 6, 1985

[54] PNEUMATIC FIBER RECOVERY AND REDISTRIBUTION SYSTEM FOR SLIVER HIGH PILE FABRIC KNITTING MACHINES

[75] Inventors: Alan L. Tilson; Earl R. Quay, both of Orangeburg; John C. Knight, North, all of S.C.

[73] Assignee: Mayer, Wildman Industries, Inc., Orangeburg, S.C.

[21] Appl. No.: 647,632

[22] Filed: Sep. 5, 1984

Related U.S. Application Data

[63] Continuation-in-part of Ser. No. 539,801, Oct. 7, 1983, abandoned.

[51] Int. Cl.[3] ..... D04B 9/14; D01G 15/40

[52] U.S. Cl. ..... 66/9 B; 19/105; 19/107; 19/109

[58] Field of Search ..... 66/9 B; 19/97, 106 R, 19/107, 109, 112, 105

[56] References Cited

U.S. PATENT DOCUMENTS 2,823,423 2/1958 Suzuki ..... 19/109

3,728,872 4/1973 Thore ..... 19/107 X 4,458,506 7/1984 Artzt et al. ..... 66/9 B

*Primary Examiner*—Louis K. Rimrodt

*Attorney, Agent, or Firm*—Harding, Earley, Follmer & Frailey

[57] ABSTRACT

Apparatus and method for removing excess fibers from the doffer of a sliver high pile fabric knitting machine and returning the fibers to the main cylinder for refeeding to the doffer. Upon the return of the fibers to the main cylinder, they are combed and aligned into a uniform layer of parallel fibers for uniform redistribution on the main cylinder and uniform mixture with fresh, incoming fibers fed by the sliver feed elements. The invention includes pneumatic suction for drawing fibers from the doffer into a substantially closed suction chamber, a rotatable filter roll within the chamber, which separates the air and the fibers and discharges the fibers from the chamber, and a sealing roll permitting the fibers to be discharged from the chamber without impairing the integrity of the vacuum therein. Fiber feeding elements composed of a rotatable wire-covered fiber return feed roll and a cooperating fiber feed plate return the recovered fibers to the main cylinder.

22 Claims, 11 Drawing Figures

PNEUMATIC FIBER RECOVERY AND REDISTRIBUTION SYSTEM FOR SLIVER HIGH PILE FABRIC KNITTING MACHINES

RELATED APPLICATION

This application is a continuation-in-part of our patent application Ser. No. 539,801, filed Oct. 7, 1983 and entitled Pneumatic Fiber Recovery and Redistribution System for Sliver High Pile Fabric Knitting Machines, now abandoned.

FIELD OF THE INVENTION

The present invention concerns the knitting of sliver high pile fabrics on circular knitting machines such as the type illustrated in Tauber U.S. Pat. No. 1,114,414, Hill U.S. Pat. No. 3,010,297, Schmidt U.S. Pat. No. 3,299,672, Wiesinger U.S. Pat. No. 3,427,829 and Thore U.S. Pat. No. 3,896,637. High pile fabric knitting machines generally are rotary knitting machines provided with a plurality of carding heads, constituting fiber transfer and feeding units, for supplying carded sliver fibers to the knitting needles. Usually, the knitting needles are mounted independently in a cylinder, which is rotatable relative to the several carding heads disposed at circumferentially spaced locations around the cylinder.

DESCRIPTION OF THE PRIOR ART

The carding heads for feeding carded sliver fibers to the needles of high pile fabric knitting machines are constituted of sliver feeding elements, usually at least one pair of rotatable sliver feed rolls generally having either wire-covered or fluted peripheries, a rotatable wire-covered main cylinder and a rotatable wire-covered doffer. The sliver feed elements draw sliver in rope form from a source of supply, and deliver the fibers, in sheet form, to the main cylinder. The latter, acting as a transfer medium, conveys the sheet of sliver fibers to the doffer which, in turn, feeds the fibers to the needles of the knitting machine. In order to properly transfer and align the fibers during their delivery to the needles, the main cylinder is caused to rotate faster than the sliver feed elements, and the doffer is caused to rotate faster than the main cylinder.

The wire-covered peripheries of the doffers heretofore utilized have been susceptible to excessive fiber build-up, which often leads to serious fabric quality problems and excessive down time of the knitting machines. Such fiber build-up on the doffer causes a lack of uniformity in the density of the pile of the fabric being knitted, and often causes needle breakage. When such problems develop, the knitting machine must be shut down while remedial measures are undertaken.

The problem of excessive fiber build up on the doffer is especially acute in patterned sliver knitting, where selected needles remove only a portion of the fibers from the doffer. The problem is an old one in sliver knitting, and has been the object of a variety of solutions, none of which have been completely satisfactory.

An early attempt to solve the problem is illustrated in Hill U.S. Pat. No. 2,953,002, which utilizes a wire-covered rotatable cleaner roll adjacent to, and in contact with, the doffer for removing excess fibers therefrom. Hill's cleaner roll, which is spaced arcuately from the doffer needle line in the direction of doffer rotation, delivers the excess fibers recovered from the doffer to a rotatable transfer roll which, in turn, delivers them to a rotatable stripper roll for transfer back to the main cylinder. The recovered fibers are mixed with the fresh incoming sliver fibers and returned to the doffer. Hill's cleaner roll was effective to a degree, but it did not fully eliminate the problem of non-uniformity of pile density, since it does not include means for redistributing uniformly the fibers returned to the main cylinder.

A later attempt to solve the problem is illustrated by Abler U.S. Pat. No. 4,006,609, where the combination of a scavenger roll and a pneumatic suction device are employed to remove from a doffer the excess fibers remaining thereon after passage of the needles through the doffer wires. Like the Hill patent aforesaid, the Abler patent was only partially successful in solving the problem. Like Hill, Alber deposits the recovered fibers onto the circumference of the main cylinder without aligning them or redistributing them uniformly. Hence, while it abates, it does not eliminate, the problem of non-uniformity in pile density.

The device of the Abler patent is further disadvantageous in that its suction hood is disposed in the vicinity of the doffer needle line, the purpose being to scavenge fly loss from the doffer and the needles, as well as remove excess fibers from the doffer circumference. However, when utilized in pattern work involving fibers of different colors or other characteristics, such arrangement results in contamination of the fibers constituting the fabric pattern. The location of Alber's suction hood at the needle line picks up and mixes fibers of different colors or characteristics due to fly loss from the needles at tuck level, which hold fibers fed at one or more previous sliver feeding stations and which have not yet been anchored by yarn.

The use of suction to remove dust, fluff and similar debris from rotatable wire-covered fiber working rolls of textile machines is old per se. Samples of such suction arrangements are illustrated in Schaefer U.S. Pat. No. 1,311,293 and Wright British Pat. No. 736,154. The use of suction in sliver knitting to return surplus fibers from the needles back to the fiber supply is disclosed in Smith British Pat. No. 195,802.

Other attempts to solve the problem of uneven layers or excessive residues of fibers on the doffer are illustrated by Smith British Pat. No. 177,472, Moore U.S. Pat. No. 1,848,370 and Kunde et al. U.S. Pat. No. 4,258,557. In all of those patents a rotatable wire-covered fiber return feed roll is utilized either to remove or redistribute excessive fibers on the doffer, by removing the excess fibers and returning them to the main cylinder, or by undertaking to redistribute them on the doffer. Those devices, however, have not proven successful in practice. They do not function to eliminate the problem of undesirable fiber build-up on the doffer, but serve merely to redistribute the unevenness of fiber density on the doffer without abating the problem.

This invention utilizes a new and improved pneumatic arrangement, employing suction, for overcoming the drawbacks of prior devices, and effectively solves the problem of non-uniformity of pile density arising from undesirable fiber build-up on the doffer.

SUMMARY OF THE INVENTION

The primary object of this invention is to provide new and improved apparatus and method for removing excess fibers from the doffer of a sliver high pile fabric knitting machine and returning the fibers to, and uniformly redistributing them on, the main cylinder for refeeding to the doffer, thereby eliminating non-uniformity of pile density in the knitted fabric.

A further object of the invention is to recover excess fibers from the doffer for return to the main cylinder and, in the course of returning the fibers, combing and aligning them into a uniform layer of parallel fibers for uniform redistribution on the main cylinder.

A further object is to uniformly redistribute the fibers recovered from the doffer so that they are uniformly mixed with fresh, incoming fibers being fed to the main cylinder by the sliver feeding elements.

A further object is to provide, for a fiber transfer and feeding unit for a sliver high pile fabric knitting machine, a novel fiber recovery system for removing excess fibers from the doffer, pneumatically sucking them into and collecting them internally of a suction chamber, then discharging the collected fibers from the chamber while maintaining the integrity of the vacuum therein, forming the discharged fibers into a uniform layer of fibers for uniform redistribution on the main cylinder and aligning the fibers while delivering them to the main cylinder for refeeding to the doffer.

A further object of the invention is to provide novel apparatus for carrying out the foregoing fiber recovery and redistribution system which includes a suction chamber in which the recovered fibers are collected pneumatically and from which they are discharged into the ambient atmosphere for reception by fiber feeding elements for returning the recovered fibers back to the main cylinder for refeeding to the doffer, the apparatus including a filter roll for separating air and fibers in the chamber, a sealing roller for maintaining the integrity of the vacuum during discharge of the fibers from the chamber and fiber feeding elements for advancing the recovered fibers, and for combing and aligning them into a uniform layer of parallel fibers while returning them to the main cylinder, whereby the recovered fibers are uniformly distributed on the main cylinder and uniformly mixed with the fresh incoming fibers disposed thereon. The elements for returning the recovered fibers to the main cylinder preferably comprise a wire-covered rotatable feed roll and a fixed fiber feed plate of the type illustrated in Quay U.S. Pat. No. 4,408,370.

The novel pneumatic fiber recovery and redistribution system of the invention not only provides for the continuous return of excess fibers from the doffer to the main cylinder, for refeeding to the doffer with fresh fibers, but it also reworks the recovered fibers, as they are returned to the main cylinder, by combing and aligning them into a layer of parallel fibers of uniform density for redistribution on the main cylinder. The recovered fibers not only are blended uniformly with the new fibers on the main cylinder, but the problem of non-uniformity of pile density in knitted high pile fabrics, which long has plagued the industry, finally is solved by this invention.

Other objects and advantages of this invention will be readily apparent from the accompanying detailed description of the preferred embodiment thereof, which is illustrated in the views of the accompanying drawing.

DESCRIPTION OF THE INVENTION

Figure 1:
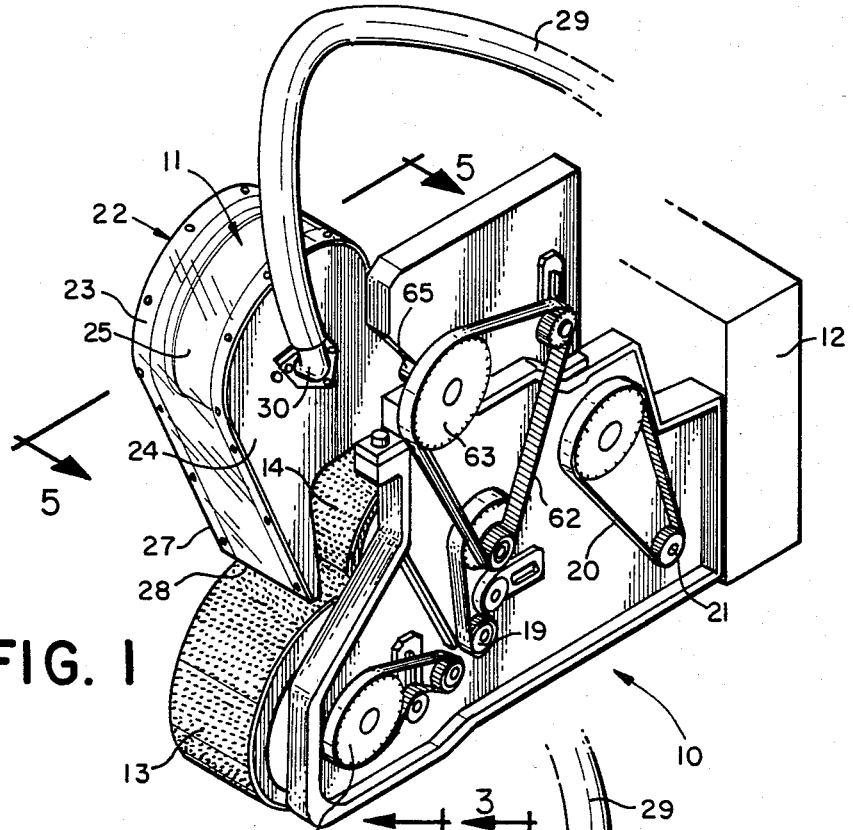
FIG. 1 is a fragmentary view in perspective of a carding head for a sliver high pile fabric knitting machine incorporating the fiber recovery and redistribution system of this invention.
Figure 2:
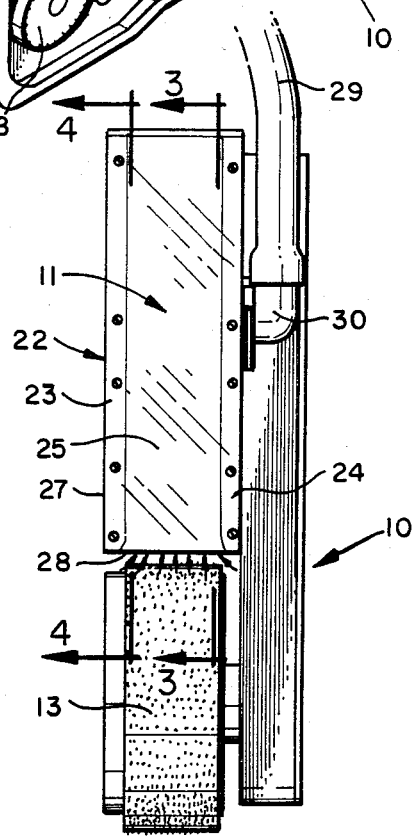
FIG. 2 is a fragmentary view in front elevation of the carding head shown in FIG. 1.
Figure 3:
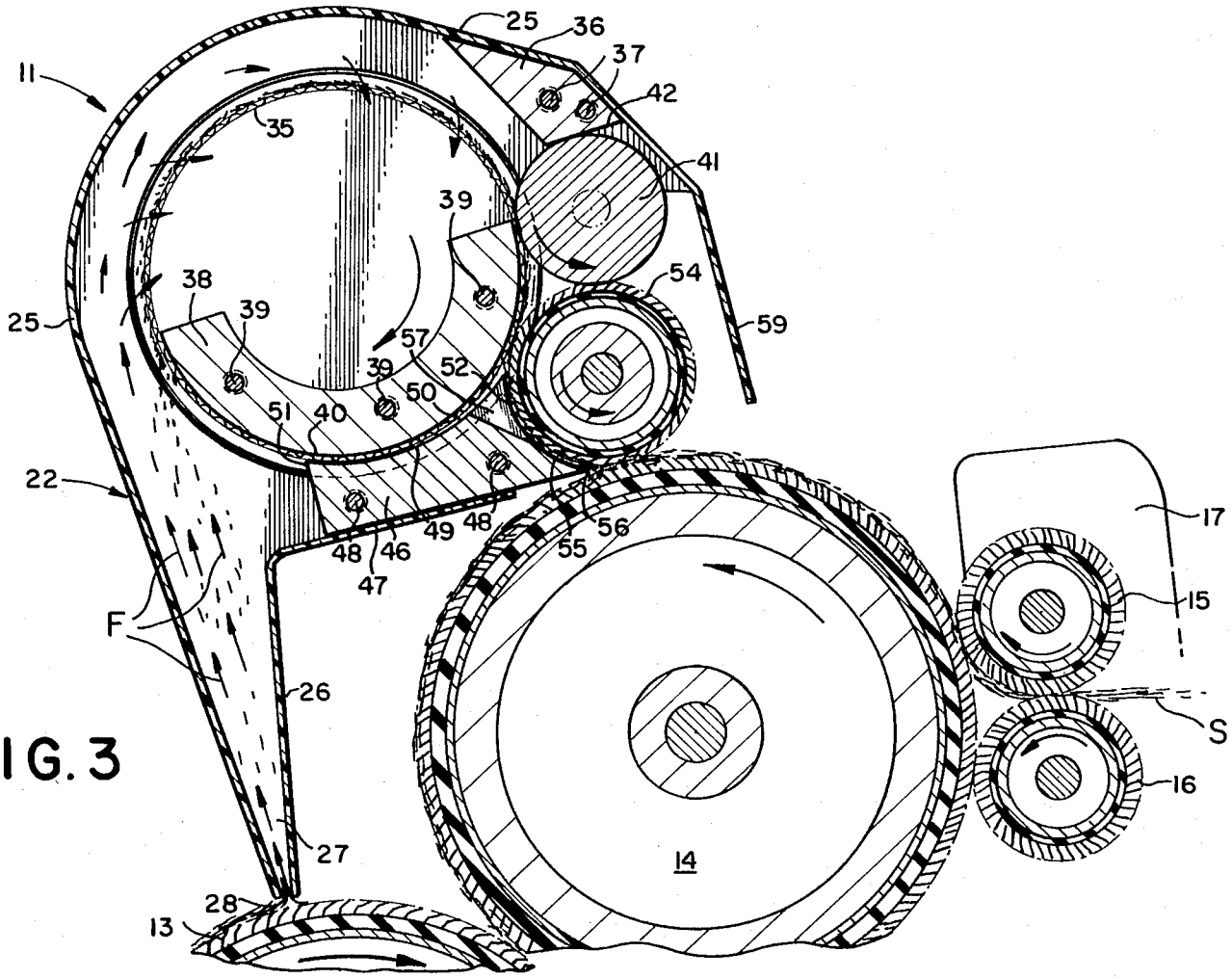
FIG. 3 is an enlarged fragmentary view in section looking in the direction of the angled arrows 3—3 of FIG. 2.

Referring first to FIGS. 1, 2 and 3 of the drawing, where a preferred embodiment of this invention is disclosed, there is illustrated a fiber transfer and feeding unit 10, often referred to as a "carding head", for processing sliver fibers and transferring and feeding them to the needles of a sliver high pile fabric knitting machine (not shown). The fiber feeding unit 10 is provided with the novel pneumatic fiber recovery and redistribution device of this invention, generally indicated by the reference numeral 11.

The fiber transfer and feeding unit 10 includes a rotatable wire-covered doffer 13 for feeding fibers to the knitting machine needles (not shown), a rotatable wire-covered main cylinder 14 and at least one pair of mating sliver feed rolls 15, 16 (FIG. 3) for feeding a sliver S to the main cylinder 14 in the usual manner. The sliver feed rolls 15, 16 are supported rotatably by the usual feed stand indicated generally by the reference numeral 17.

The doffer 13, main cylinder 14 and sliver feed rolls 15, 16 are driven, respectively, by conventional pulley systems 18, 19 and 20. The pulley drive systems 18 and 19 for the doffer 13 and main cylinder 14 are driven from the ring gear of a knitting machine by a conventional gear drive system (not shown). The pulley drive system 20 for driving the feed rolls is connected to a drive shaft 21 which, in turn, may be connected to a stepping motor (not shown) under the control of a suitable electronic system indicated generally by the reference numeral 12. Such a stepping motor—electronic control system is disclosed, for example, in Christiansen et al. U.S. Pat. No. 4,007,607. Alternatively, the sliver feed roll shaft 21 may be driven by the ring gear of the knitting machine through conventional gearing (not shown).

The pneumatic fiber recovery and redistribution device 11 includes a suction chamber 22 having horizontally spaced vertical side walls 23, 24, which may be of metal, plastic or other rigid material, a front wall 25, which extends upwardly and over the top of the vacuum chamber 22, and a rear wall 26. The front and rear walls 25, 26 of the chamber 22 preferably are formed of transparent plastic material, and span the distance between, and are rigidly connected to, the spaced vertical side walls 23, 24.

The suction chamber formed by the four sealed walls 23–26 is of approximately the same width as the doffer 13. The lower portions of the spaced side walls 23, 24 taper inwardly to provide the chamber 22 with a depending portion 27 which terminates in a narrow, transversely extending suction mouth or nozzle 28 located proximate the wire-covered periphery of the doffer 13. Suction mouth 28 is disposed very close to the distal ends of the wire clothing of the doffer 13, on the order of 0.5 mm, and extends substantially the full width of the periphery of the doffer 13. Like the cleaner roll of Hill U.S. Pat. No. 2,953,002 aforesaid, suction mouth 28 is spaced arcuately from the doffer needle line in the direction of doffer rotation.

The interior of the chamber 22 is connected to a vacuum manifold (not shown) by a hollow conduit 29. The conduit 29 connects to a suitable hollow fitting 30 affixed to side wall 24 of the chamber. The hollow of fitting 30, in turn, communicates with the interior of the suction chamber 22 via an aperture 31 (FIG. 6), preferably tapered, formed in the side wall 24. The suction manifold aforesaid (not shown) is suitably connected to any conventional vacuum source, such as a blower (also not shown). In operation, atmospheric air is sucked into the chamber 22 via the elongated suction mouth 28 proximate the doffer 13, and discharges from the chamber 22 via aperture 31 in wall 24, fitting 30 and conduit 29 to the suction manifold. As a result, excessive fibers on the wires of the doffer 13 are drawn through suction mouth 28 into the chamber 22 for refeeding to the main cylinder 14. Since the suction mouth 28 is located away from the doffer needle line, the sucking up of needle fly loss is avoided, thereby avoiding the fiber contamination problem inherent in Alber U.S. Pat. No. 4,006,609 aforesaid.

Figure 6:
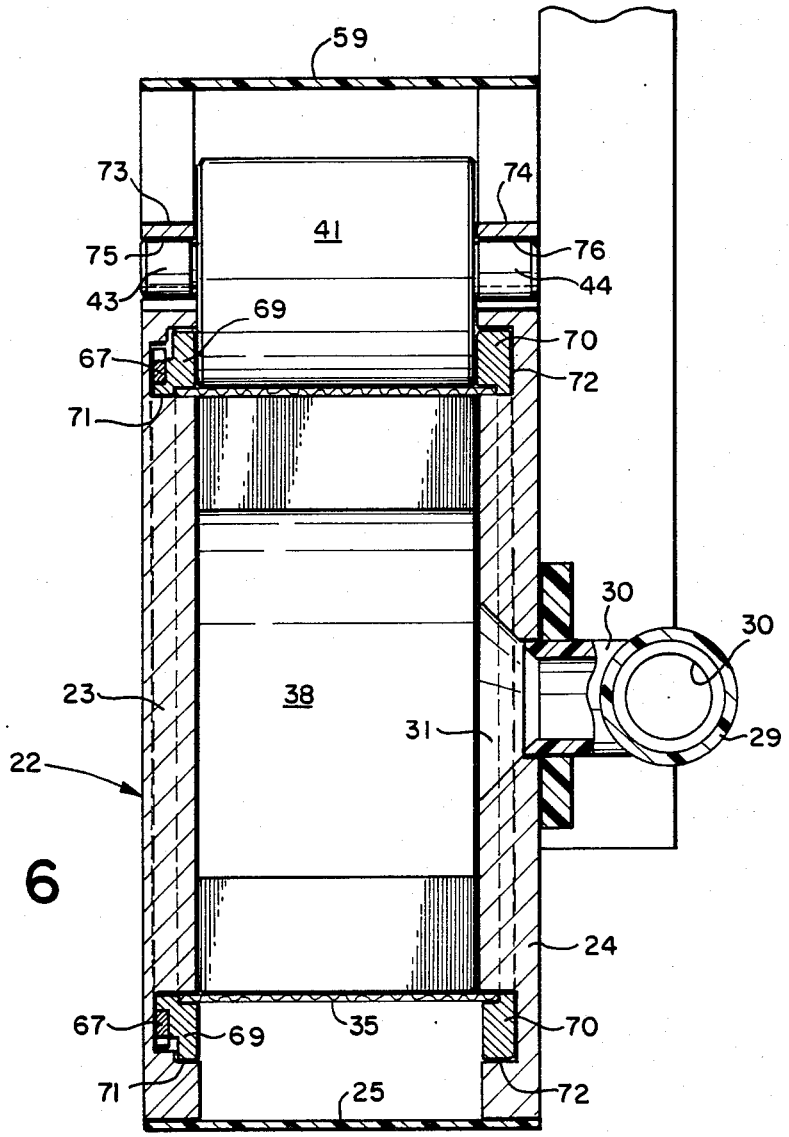
FIG. 6 is an enlarged fragmentary view in section looking in the direction of the angled arrows 6—6 of FIG. 5.

The basic components of the pneumatic suction device 11 are illustrated in FIG. 3. Rotatably mounted within the upper, enlarged portion of the suction chamber 22 is a hollow, foraminous filter roll 35. The rotatable filter roll 35 is in the form of an annular screen which extends across the full width of the interior of the chamber 22 (FIG. 6). The hollow of the annular filter roll 35 is in communication with the suction manifold aforesaid via aperture 31, fitting 30 and conduit 29. The perforated filter roll 35 is supported rotatably by the spaced side walls 23, 24 of the chamber 22, as will be more fully explained.

Disposed internally of the suction chamber 22, above and to the rear of the rotatable filter roll 35, is a transversely extending upper sealing bar 36. The sealing bar 36 is contiguous with the internal surface of the rear portion of the front wall 25, and extends the full width of the chamber 22 between the side walls 23, 24. It is attached to the interiors of the side walls 23, 24 in fluid-tight relationship by bolts 37, or other suitable securing means.

Affixed internally of the rotatable foraminous filter roll 35, adjacent its bottom, is a second transversely disposed sealing bar 38 which extends across the full width of the interior of the chamber 22 (FIG. 6). It is secured in fluid-tight relationship to the interiors of the spaced side walls 23, 24 by plural bolts 39, or other suitable securing means. The outer convex surface 40 of the internal sealing bar 38 is smooth, arcuate and coradial with the annular filter roll 35, and is located in close proximity to the inner annular surface of that roll, with a slight clearance of about 0.1 mm. Thus, the lower inner surface of the foraminous roll 35 glides over the complemental outer arcuate surface 40 of the inner sealing bar 38 during rotation of the roll.

Interposed between the outer surface of the perforated filter roll 35 and the upper sealing bar 36 is a smooth-peripheried rotatable sealing roller 41. The sealing roller 41 also extends across the full internal width of the chamber 22 (FIG. 6). It is operative to substantially close the suction chamber 22 at the location where fibers recovered from the doffer 13 are discharged from that chamber.

The upper portion of the periphery of the sealing roller 41 is in close proximity to the transversely extending flat or planar surface 42 of the upper sealing bar 36, the clearance here also being on the order of 0.1 mm. The front portion of the periphery of the sealing roller 41 is contiguous with the outer foraminous surface of the hollow filter roll 35 at the location where the perforated shell of the filter roll commences passing over the outer arcuate surface 40 of the inner sealing bar 38. The contiguousness of the rotatable filter roll 35 with the periphery of the rotatable sealing roller 41 at that location and its near contiguousness with the outer surface 40 of the stationary inner sealing bar 38 provides an air restricted fiber passage to help maintain the integrity of the vacuum in suction chamber 22 at that junction. The near contiguousness of the rotatable sealing roller 41 with the flat surface 42 of the fixed sealing bar 36 also helps maintain the vacuum in chamber 22. As will be more fully explained, the sealing roller 41 is provided with integral stud shafts 43, 44 (FIG. 6) which are supported rotatably by the side walls 23, 24 of chamber 22.

Disposed adjacent to and partially internally of the suction chamber 22, below the rotatable shell of the filter roll 35, is a transversely extending fiber feed plate 46. The plate 46 is contiguous to the interior surface of the rearwardly extending portion 47 of the rear wall 26 of the chamber 22. Feed plate 46 extends across the full internal width of chamber 22, and is secured to the interior surfaces of its side walls 23, 24 in fluid-tight relationship by bolts 48, or other suitable fastening devices.

The upper transverse surface 49 of the feed plate 46 is concave, and is closely spaced to the exterior annular surface of the foraminous filter roll 35 to provide a tapered gap 50. The gap 50 reduces in depth progressively toward the front of the chamber 22, so that the front portion of the upper surface 49, adjacent to its transverse front edge 51, is in very close proximity to the shell of the filter roll 35, the clearance being only about 0.05 mm. The near contiguousness of the rotatable filter shell 35, the fixed inner sealing bar 38 and the fixed feed plate 46 adjacent the transverse edge 51 helps maintain, at that transverse area, the integrity of the vacuum in chamber 22. The tapered gap 50 may be on the order of 1.0 mm in thickness at its rear end, and may gradually reduce in thickness to a clearance of about 0.05 mm along the area adjacent to transverse edge 51.

Figure 7:
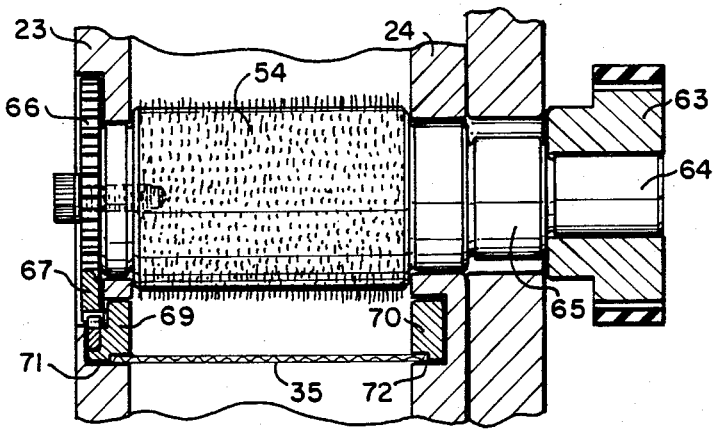
FIG. 7 is an enlarged fragmentary view in section looking in the direction of the angled arrows 7—7 of FIG. 5.

A rotatable wire-covered fiber return feed roll 54 is mounted rotatably on side walls 23, 24 (FIG. 7), adjacent the sealing roller 41, the filter roll 35, the feed plate 46 and the main cylinder 14. Very slight working clearances are maintained between the wire periphery of the return feed roll 54 and the adjacent peripheries of the filter roll 35 (1.0 mm) and the main cylinder 14 (0.1 mm).

The fiber feed plate 46 is provided with a concave, transversely extending rear surface 52 adjacent the rotatable fiber return feed roll 54. The rearwardly disposed curved surface 52 of the feed plate 46 is complemental and closely spaced to the wire periphery of the feed roll 54, to provide a continuous fiber feed gap 55 of about 0.2 mm in thickness. Gap 55 terminates in a fiber discharge point 56 in close proximity to the distal ends of the wires of the main cylinder 14, preferably of a clearance not in excess of 0.1 mm.

When the suction device 11 is operative, and air is sucked into the chamber 22 via the elongated suction mouth 28, the excess fibers on the doffer 13 are entrained with the moving air and drawn into the chamber 22, as illustrated in FIG. 3. Preferably, the transverse center line of the suction mouth 28 is disposed in a plane generally tangential to the outer surface of the filter roll 35. The fibers F removed from the doffer 13 and drawn into the chamber 22 pass around the foraminous roll 35 to the sealing roller 41. The incoming air passes through the perforations of the roll 35 and out of the chamber 22 via aperture 31, fitting 30 and conduit 29 to the suction manifold aforesaid.

At relatively low rates of fiber accumulation in chamber 22, the recovered fibers F are delivered by the air flow to the chamber exit defined by filter roll 35 and sealing roller 41 for immediate discharge to the ambient atmosphere. At higher rates of fiber flow, the incoming fibers tend to accumulate adjacent the restricted chamber exit. In such case, the quantities of fibers in the exiting fiber layer are greater, i.e. the compressed layer of fibers is denser. The sealing roller 41 and the filter roll 35 function to maintain the outflow of fibers from the chamber 22 at a substantially consistent rate, although the quantities of fibers being discharged may vary, depending on the rate at which fibers are sucked from the doffer 13 into the chamber 22. In practice, it has been found that highly satisfactory results are achieved when the surface speed of the filter roll is about 4% of that of the doffer 13.

The discharged fibers, clinging to the exterior surface of the rotating filter roll 35, are delivered to the rotating fiber return feed roll 54, the wire periphery of which removes the fibers from the filter roll 35 and delivers them, via the fiber feed gap 55 and fiber discharge point 56, to the wire-covered periphery of the main cylinder 14 for refeeding to the doffer 13. The recovered fibers F are mixed on the main cylinder 14 with the fresh incoming fibers of the sliver S being fed by the sliver feed rolls 15, 16.

The surface speed of the main cylinder 14 preferably is on the order of about 7 times higher than the surface speed of the return feed roll 54 to provide a fiber draw ratio of about 7:1. Such surface speed differential, together with the relatively elongated, smooth and narrow fiber passage provided by the fiber feed gap 55, terminating in the fiber discharge point 56, ensures that the recovered fibers F are combed into a uniform sheet or film of parallel fibers upon their return to the main cylinder 14. Thus, the fibers F are uniformly redistributed on the main cylinder 14 and uniformly mixed with the incoming fibers from the sliver S.

The fiber return feed area for uniformizing the recovered fibers and returning them to the main cylinder 14 is located in the ambient atmosphere and is defined by the sealing roller 41, return feed roll 54, fiber feed plate 46 and the portion of the arcuate surface 40 of the internal sealing bar 38 which is disposed externally of the vacuum chamber 22. To ensure full removal of the recovered fibers F by the return feed roll 54 from the surface of the filter roll 35, as the latter exits from chamber 22 and passes through the fiber return feed area, the surface speed of feed roll 54 should be about 50% greater than the surface speed of filter roll 35. The fiber return feed area may be protected by a rearwardly extending cover 59 suitably affixed to the back of the chamber 22.

To facilitate the smooth, continuous and uniform transfer of the recovered fibers back to the main cylinder 14, small clearances 57 may be formed in the upper rear portion of the feed plate 46 adjacent the inner surfaces of the vacuum chamber side walls 23, 24. The transversely spaced clearances 57 prevent the accumulation of fibers at the junctions between the inner surfaces of the spaced side walls 23, 24 and the adjacent ends of the curved rear surface 52 of feed plate 46.

Figure 4:
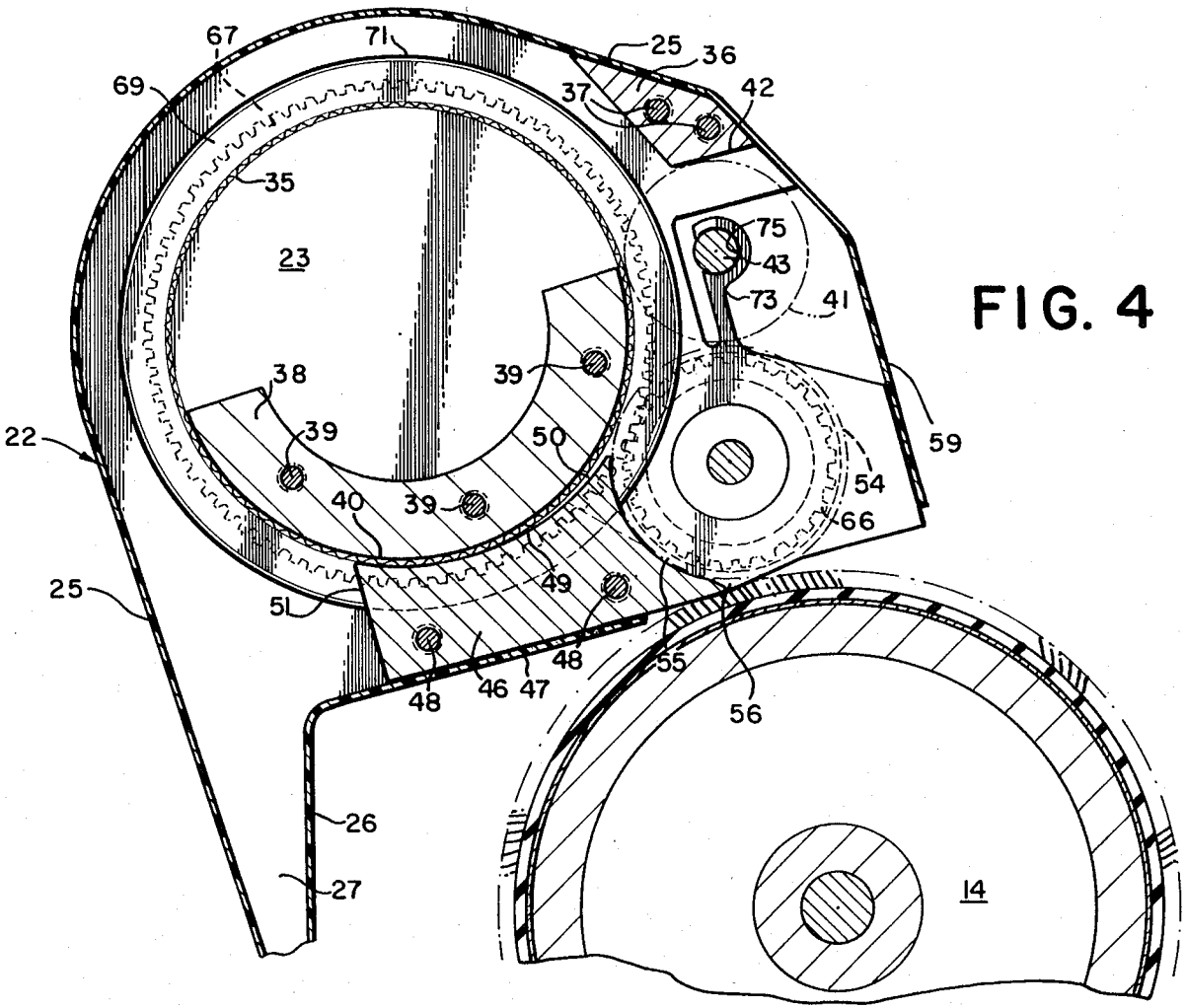
FIG. 4 is an enlarged fragmentary view in section looking in the direction of the angled arrows 4—4 of FIG. 2.
Figure 5:
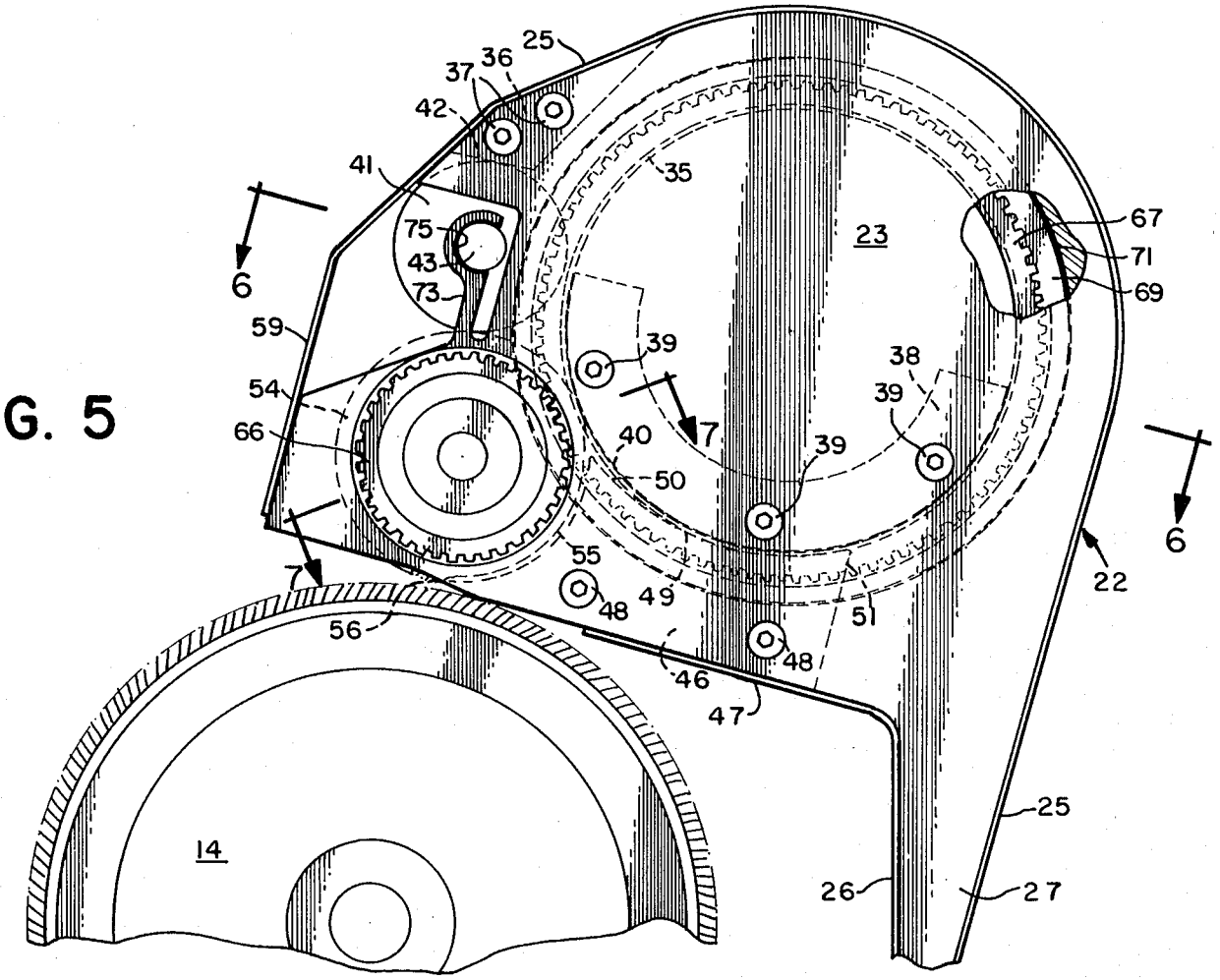
FIG. 5 is an enlarged fragmentary view in side elevation looking in the direction of the angled arrows 5—5 of FIG. 1.

Turning to FIGS. 1 and 4 to 7 inclusive, the drive system for the rotatable components of the pneumatic suction device 11 now will be described. Rotational drive is imparted to the fiber return feed roll 54 by a pulley drive system 62 (FIG. 1) which, in turn, is connected drivingly to the pulley drive system 19 for the main cylinder 14. The return feed roll pulley drive system 62 includes a toothed pulley 63 mounted on the reduced exterior portion 64 (FIG. 7) of the rotatable shaft 65 to which the return feed roll 54 is affixed. Secured to the opposite end of the return feed roll shaft 65 is a drive gear 66 which meshes with a relatively large ring gear 67 affixed to the filter roll 35 to impart rotation to that roll (FIGS. 4, 5).

Referring to FIG. 6, it will be observed that filter roll 35 is provided with a pair of axially spaced rings 69, 70, preferably metallic, which impart rigid support to that roll. The filter roll ring gear 67 is affixed to the filter roll support ring 69 by any suitable, conventional arrangement, such as a force fit on a reduced annular area of ring 69 as illustrated in FIG. 6. To accommodate the spaced filter roll rings 69, 70, complementary annular grooves are formed in the inner surfaces of the chamber side walls 23, 24. More particularly, to accommodate the combination of the filter roll ring 69 and its attached ring gear 67, a compound annular groove 71 is formed in the interior face of side wall 23. Similarly, an annular groove 72 is formed in the interior face of the side wall 24 to accommodate the filter roll ring 70. The two axially spaced annular grooves 71, 72 retain, and rotatably support, their corresponding filter roll rings 69, 70.

Thus, the side walls 23, 24, by their respective grooves 71, 72, function as bearing surfaces for the rotatable filter roll support rings 69, 70 when rotation is imparted to the filter roll 35 via pulley drive system 62, return feed roll shaft 65, drive gear 66 and ring gear 67. To ensure proper bearing support for the rotatable filter roll 35, the spaced side walls 23, 24 of the chamber 22 preferably are composed of a suitable plastic bearing material, such as lubricated nylon. A satisfactory product for this purpose is a Polymer Corporation bearing material composed of nylon impregnated with dry lubricants, sold under the trademark "NYLATRON".

The sealing roller 41 is freely rotatable. By reason of their frictional contact, the rotating filter roll 35 imparts rotation to the sealing roller 41. The spaced stud shafts 43, 44 of the sealing roller 41 are supported rotatably by horizontally spaced spring fingers 73, 74 comprising, respectively integral elements of the side walls 23, 24.

Referring to FIGS. 4 and 5, it will be observed that the lower portion of the upstanding spring finger 73 is integrally joined to the rear portion of the side wall 23, but that its upper portion is spaced therefrom, thereby imparting a resilient function to the finger 73. The distal end of resilient finger 73 is provided with an arcuate, yokelike notch 75 for supporting rotatably stud shaft 43 of the sealing roller 41.

Spring finger 74 corresponds fully to spring finger 73 in its relative location on side wall 24 and in its construction and function. More specifically, its proximal end (not shown) is integral with the rear portion of the side wall 24, and its distal end is provided with an arcuate, yoke-like opening 76 (FIG. 6) for supporting rotatably the stud shaft 44 of the sealing roller 41.

The spaced pair of resilient spring fingers 73, 74 continuously urge the sealing roller 41 against the perforated surface of the filter roll 35. The frictional contact between the peripheries of the sealing roller 41 and the filter roll 35 enables the filter roll to impart continuous rotation to the sealing roll. As will be observed from FIGS. 4, 5 and 6, the forward portion of the rotating sealing roll 41 nestles snugly between the spaced filter roll support rings 69, 70. To minimize interference between those rotating elements, a clearance on the order of 0.2 mm should be maintained between the spaced vertical side walls of the sealing roller 41 and the adjacent rotatable support rings 69. 70. The foraminous shell or screen of the filter roller 35 preferably is composed of stainless steel wire and has a thickness on the order of 0.5 mm. Its perforations or apertures preferably are on the order of 0.5 mm in diameter. The mating sealing roller 41 preferably is constituted of stainless steel, also.

The rotation of the sliver feed rolls 15, 16 is selectively controlled in any well known manner to accurately meter the quantities of fresh sliver fibers S fed to the main cylinder 14. Such control means may be constituted by a microprocessor which controls a stepping motor connected to the feed rolls 15, 16 to regulate the rate of sliver feed in coordination with needle selection during operation of the knitting machine, in the manner disclosed in U.S. Pat. No. 4,007,607 aforesaid. Of course, the sliver feed rolls 15, 16 may be replaced by suitable equivalent means, such as a fixed sliver feed plate in combination with a rotatable sliver feed roll, as disclosed in Quay U.S. Pat. No. 4,408,370.

In the practice of this invention, the rate of feed of the incoming sliver fibers S may be carefully controlled by the microprocessor not only in relation to the needle selection of the pattern being knit, but also in relation to the rate at which excessive fibers on the doffer 13 are recovered and transferred back to the main cylinder 14 via the pneumatic suction device 11.

The pneumatic fiber recovery and redistribution system of this invention not only provides a continuous return of excess fibers from the doffer 13 to the main cylinder 14, but it reworks the recovered fibers, as they are returned, to form them into a layer of aligned fibers of uniform density for redistribution on the main cylinder and uniform mixture with the incoming fibers from the feed rolls 15, 16. Not only are the recovered fibers blended uniformly with the fresh incoming fibers, but the long subsisting problem of non-uniform pile density in the fabric, arising from non-uniform layers or residues of fibers on the doffer, is solved by this invention.

This invention is especially applicable to the knitting of patterned sliver high pile fabrics where, at different sliver feeding stations, selected needles rather than the full complement of needles are elevated to rake fibers from the doffer. In that type of knitting, the unused fibers which remain on the doffer, as a result of needle selection, present the problem. Those fibers become "excess", and can cause rapid and undesirable fiber build up on the doffer. This invention ensures that the unused fibers remaining on a doffer, because of needle selection, are removed, recycled and redistributed uniformly back to the main cylinder for refeeding to the doffer.

In the modifications of the invention illustrated in FIGS. 8–11, parts identical to those illustrated in FIGS. 1–7, for the sake of clarity, bear identical reference numerals. Likewise for the sake of clarity, parts illustrated in FIGS. 8–11 which are modified from, but are equivalent to, parts illustrated in FIGS. 1–7 bear the corresponding reference numeral of such parts modified by the "prime" symbol.

Figure 8:
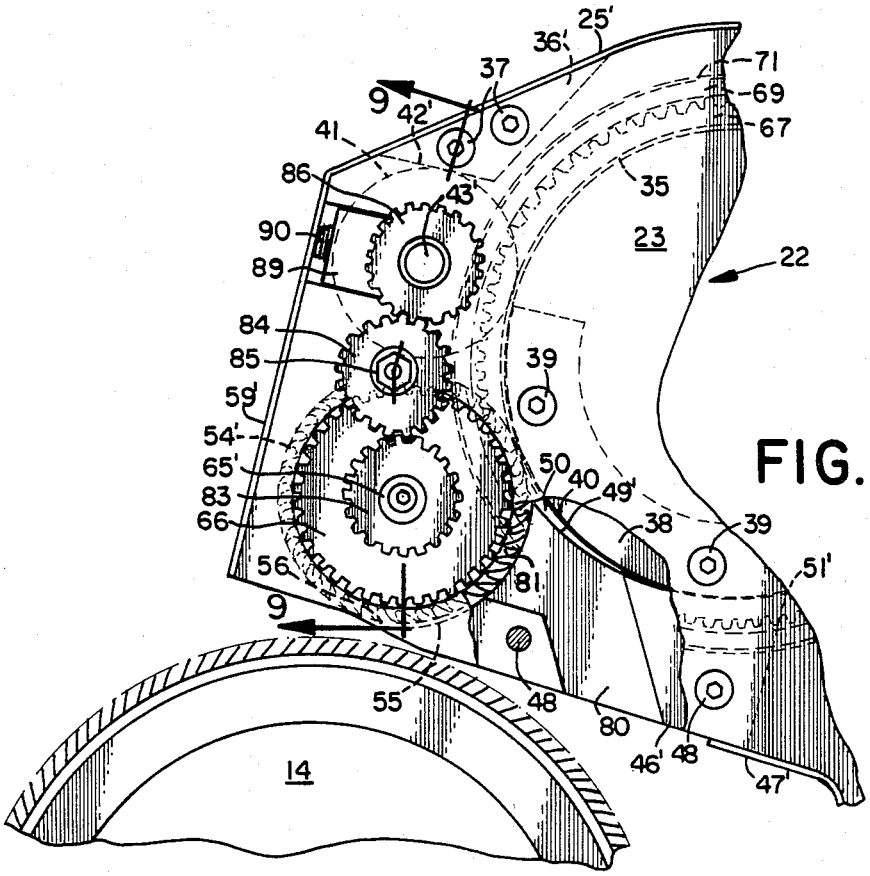
FIG. 8 is a fragmentary view similar to FIG. 5 showing a modification of the invention.

Thus, there is illustrated in FIG. 8 main cylinder 14, suction chamber 22, side wall 23, rotatable filter roll 35, stationary inner sealing bar 38 and its outer convex surface 40, tapered gap 50, filter roll ring gear 67, filter roll ring 69 and its complemental annular groove 71 formed in the interior face of side wall 23. The rear portion of the front wall 25′ of the suction chamber 22 has been slightly modified in the embodiment illustrated in FIG. 8, as has the rear wall portion 47′ and the rear cover 59′, such modifications being complementary to modifications made to the upper sealing bar 36′, modified fiber feed plate 46′ and the gearing interposed between fiber return feed roll 54′ and sealing roller 41, by means of which the sealing roller is driven positively.

Figure 9:
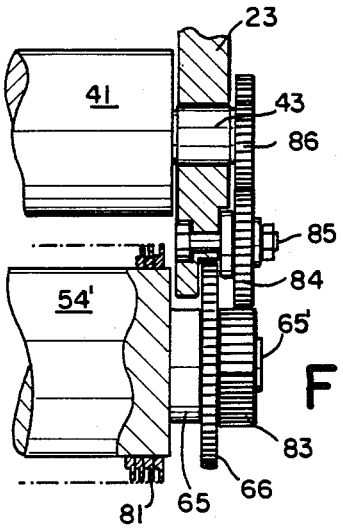
FIG. 9 is a fragmentary view in partial section looking in the direction of the angled arrows 9—9 of FIG. 8.

More specifically, in the modification illustrated in FIGS. 8 and 9, shaft 65 of return feed roll 54′ is provided with an extension 65′ extending outwardly from drive gear 66 on which is mounted a second drive gear 83 having a diameter smaller than that of drive gear 66. The additional drive gear 83 meshes with idler gear 84 which, in turn, meshes with driven gear 86 mounted on an axial extension 43′ of stud shaft 43 of sealing roller 41 to drive that roller. Idler gear 84 is affixed to stud shaft 85 which, in turn, is supported rotatably by side wall 23. A freely slidable bearing 89, supported by side wall 23 and under the resilient pressure of compression spring 90, bears against stud shaft 43 to maintain the sealing roll 41 in its proper operative position, with its gear 86 meshing with idler gear 84, and its smooth-peripheried surface in close proximity to surface 42′ of sealing bar 36′ and to the periphery of filter roll 35. In the embodiment of FIGS. 8 and 9, drive gear 66 of the return feed roll 54′ continues to mesh with and drive ring gear 67 to impart rotation to filter roll 35, as explained heretofore.

In the modification of FIGS. 8 and 9, fiber return feed roll 54′ is illustrated as having a saw-toothed wire covering 81 of the type, for example, illustrated in Quay U.S. Pat. No. 4,408,370. Feed plate 46′ includes upper concave surface 49′ and transverse front edge 51′ and, together with feed roll 54′, provides feed gap 55 and fiber discharge point 56. However, clearances 57 are omitted from feed plate 46′ and, in lieu thereof, there is provided on each side of feed plate 46′ a relatively wide, downwardly extending relief or clearance 80 which, at its lower end, opens to the ambient atmosphere. The two transversely spaced reliefs 80 of feed plate 46′ function to prevent fibers from being pulled between feed plate 46′ and filter roll 35 as the latter rotates. In addition, the downwardly extending reliefs, open to the ambient atmosphere, aid in removing foreign matter which may accumulate around the feed plate 46'. As shown in FIG. 8, rear wall portion 47' of suction chamber 22 has been shortened to enable the reliefs 80 to communicate with the ambient atmosphere.

Figure 11:
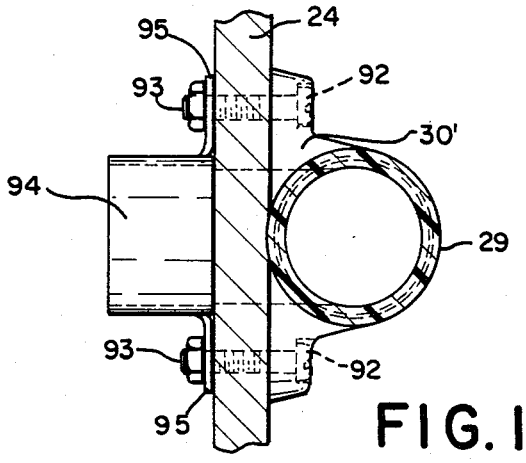
FIG. 11 is a fragmentary view in section looking in the direction of the angled arrows 11—11 of FIG. 10.
Figure 10:
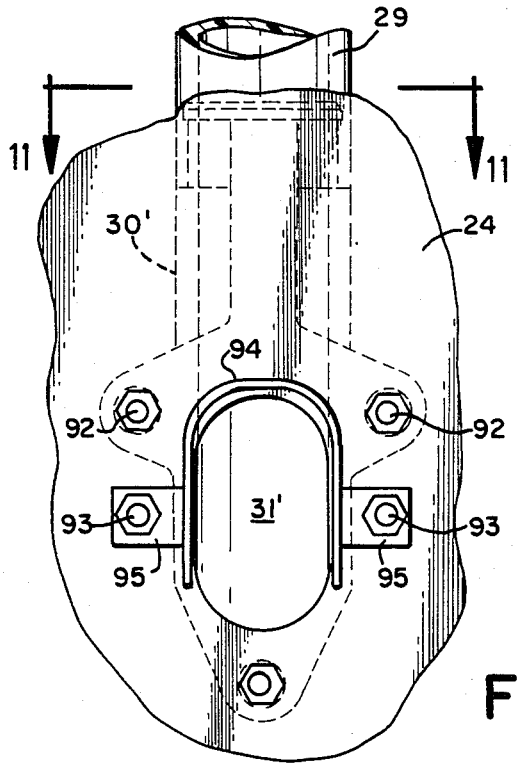
FIG. 10 is an enlarged, fragmentary view of a further modification of the invention.

FIGS. 10 and 11 illustrate a modified arrangement for connecting hollow conduit 29 to the interior of the suction chamber 22. In this embodiment, the conduit 29 connects to a modified, elbow-like hollow fitting 30' affixed to the exterior of the side wall 24 of the suction chamber 22 by means of bolts 92, or other suitable fastening means. The hollow fitting 30', in turn, communicates with the interior of the suction chamber 22 via the elongated aperture 31' formed in the side wall 24.

Affixed to the interior of the side wall 24, by means of bolts 93, is a hood-like baffle 94, dimensioned to extend inwardly of suction chamber 22 a short distance from the interior of wall 24. Baffle 94 is of inverted U-shaped cross section, and envelops the upper curved portion and substantially the whole of the spaced side portions of aperture 31'. Apertured ears 95 extend laterally from the spaced depending legs of baffle 94 and function as mounting means by which the baffle is secured by the bolts 93 to the interior of side wall 24.

The presence of baffle 94 within the suction chamber 22 tends to stabilize the suction currents generated within the chamber, and thereby minimizes any tendency for the fibers F to drift in the direction of the aperture 31' during their travel toward sealing roller 41. Thus, baffle 94 functions to ensure that fibers F remain centered relative to the rotatable foraminous filter roll 35 during their travel through the suction chamber.

If desired, the foraminous filter roll 35, instead of being rotatable, may be stationary and function as a fixed screen to separate the incoming air and fibers F in the suction chamber 22. In such event, depending on the arrangement of the component parts of the unit, an additional rotatable roller may be required for cooperation with the sealing roller 41 for discharge of the fibers F into the fiber return feed area aforesaid located externally of the suction chamber.

Although preferred embodiments of this invention have been shown and described herein for the purpose of illustration, it is to be understood that various changes, modifications and alterations may be made thereto without departing from the spirit and utility of this invention, or from the scope thereof as set forth in the claims.

We claim:

1. A fiber recovery and redistribution device for a fiber transfer and feeding unit for a sliver high pile fabric knitting machine, said unit including a doffer, a main cylinder and a pair of sliver feeding elements, said device being characterized by (a) a suction chamber, (b) suction means for removing fibers pneumatically from the doffer into the suction chamber, (c) filter means for separating the air and removed fibers internally of the suction chamber, (d) fiber discharge means for discharging the fibers from the suction chamber and (e) fiber return feed means disposed externally of the suction chamber for delivering the discharged fibers to the main cylinder, (f) said fiber return feed means including means for forming the discharged fibers into a uniform layer of aligned fibers for uniform redistribution upon the main cylinder.

2. The device of claim 1, characterized by (a) a rotatable foraminous fiber filter roll mounted within the chamber for separating the air and removed fibers and (b) drive means for imparting rotation to the filter roll.

3. The device of claim 1, characterized by (a) a fiber return feed roll disposed adjacent to the suction chamber and (b) a fiber feed plate disposed adjacent to both the fiber return feed roll and the suction chamber, (c) said fiber feed plate having a concave surface disposed proximate to the periphery of the fiber return feed roll to provide a fiber passage for delivery of the fibers to the main cylinder, (d) said fiber passage terminating in a fiber discharge point proximate the main cylinder.

4. The device of claim 1, characterized by a fiber discharge means including (a) a rotatable fiber filter roll having a periphery for collecting removed fibers, (b) a rotatable sealing roller disposed adjacent the suction chamber, (c) said sealing roller having a periphery disposed proximate the filter roll periphery, and (d) resilient means urging the sealing roller into peripheral contact with the filter roll.

5. The device of claim 4, characterized by sealing roller support means disposed externally of the suction chamber.

6. The device of claim 1, characterized by a wire-covered fiber return feed roll and a fiber feed plate disposed intermediate the fiber discharge means and the main cylinder.

7. The device of claim 1, characterized by fiber discharge means composed of (a) a rotatable fiber filter roll having a shell for collecting removed fibers within the suction chamber and conveying said fibers out of the chamber, (b) a fixed sealing bar disposed internally of the shell, (c) a rotatable sealing roller disposed adjacent the suction chamber and externally of the shell, (d) said sealing roller having a periphery disposed proximate the filter roll shell at a location adjacent the fixed sealing bar, and (e) resilient means urging the sealing roller into peripheral contact with the filter roller shell.

8. The device of claim 1, characterized by (a) a hollow fiber filter roll mounted rotatably within the suction chamber, said roll having a foraminous shell for collecting removed fibers within the chamber and conveying said fibers out of the chamber, (b) drive means for imparting rotation to the filter roll, (c) fiber discharge means permitting the foraminous shell to emerge from the suction chamber during rotation of the filter roll, (d) said fiber discharge means comprising (i) a rotatable sealing roller disposed externally of the filter roll shell and (ii) a fixed sealing bar disposed internally of the filter roll shell, (e) and an entrance spaced arcuately from the fiber discharge means for reentry of the foraminous shell into the suction chamber.

9. The device of claim 8, characterized by a rotatable fiber return feed roll and a cooperating fiber feed plate located intermediate the fiber discharge means and the main cylinder.

10. The device of claim 9, characterized by (a) a wire-covered fiber return feed roll disposed adjacent the main cylinder and
(b) a fiber feed plate disposed adjacent the fiber return feed roll and the main cylinder,
(c) said fiber feed plate having an arcuate surface complemental to and disposed proximate to the fiber return feed roll to provide a narrow fiber passage for delivery of fibers to the main cylinder.

11. The device of claim 9, characterized by drive means connecting the fiber return feed roll to the filter roll for imparting rotation to the filter roll.

12. The device of claim 11, characterized by
(a) a drive means for imparting rotation to the main cylinder and the fiber return feed roll,
(b) said drive means being operative to rotate the fiber return feed roll at a greater surface speed than the surface speed of the fiber filter roll and to rotate the main cylinder at a greater surface speed than the surface speed of the fiber return feed roll.

13. The device of claim 11, characterized by
(a) drive means for imparting rotation to the fiber return feed roll and to the main cylinder,
(b) said drive means being operative to rotate the main cylinder at a greater surface speed than the surface speed of the fiber return feed roll,
(c) whereby the fibers are combed as they are discharged from the fiber passage to the main cylinder.

14. The device of claim 1, characterized by
(a) said fiber discharge means including at least one rotatable sealing roller disposed adjacent the suction chamber,
(b) said sealing roller being operative to aid in maintaining a vacuum internally of the suction chamber and
(c) drive means for imparting rotation to the sealing roller.

15. The device of claim 14, characterized by a fiber filter roll mounted rotatably within the suction chamber, said fiber filter roll imparting rotation to the sealing roller.

16. The device of claim 14, characterized by
(a) a rotatable fiber return feed roll disposed externally of the suction chamber and
(b) drive means connecting the fiber return feed roll to the sealing roller to impart rotation to the sealing roller.

17. The device of claim 1, characterized by baffle means located internally of the suction chamber, said baffle means being operative to minimize the tendency of the removed fibers to drift in the chamber relative to the fiber discharge means.

18. The method of recovering fibers from the doffer of a fiber transfer and feeding unit for a sliver high pile fabric knitting machine and redistributing the fibers on the main cylinder of said unit, characterized by the steps of
(a) removing fibers by suction from the doffer,
(b) sucking the removed fibers into a suction chamber,
(c) collecting the fibers internally of the suction chamber,
(d) discharging the collected fibers from the suction chamber and
(e) forming said discharged fibers into a uniform layer of aligned fibers while delivering said fibers to the main cylinder.

19. The method of claim 18, wherein the fibers are removed pneumatically and entrained by air into the suction chamber, characterized by the step of continuously separating the air and the removed fibers internally of the chamber.

20. The method of claim 18, characterized by the step of combing the fibers as they are delivered to the main cylinder.

21. The method of claim 18, characterized by the step of continuously removing the fibers from the suction chamber and delivering them to the main cylinder while maintaining the integrity of the vacuum internally of the suction chamber.

22. The method of claim 18, characterized by the step of continuously transferring the discharged fibers from the suction chamber to the main cylinder via an elongated, smooth and narrow fiber passage.

* * * * *